US008306469B2

(12) United States Patent
Kimura et al.

(10) Patent No.: US 8,306,469 B2
(45) Date of Patent: Nov. 6, 2012

(54) CLEANING APPARATUS FOR REMOVING TONER ADHERED ONTO ENDLESS BELT

(75) Inventors: Yoshiyuki Kimura, Tokyo (JP); Hiroshi Ishii, Tokyo (JP); Ryuta Takeichi, Tokyo (JP); Masaharu Furuya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/186,900

(22) Filed: Aug. 6, 2008

(65) Prior Publication Data

US 2008/0298833 A1 Dec. 4, 2008

Related U.S. Application Data

(62) Division of application No. 10/926,180, filed on Aug. 26, 2004, now Pat. No. 7,421,239.

(30) Foreign Application Priority Data

Aug. 26, 2003 (JP) ..... 2003-301278
Sep. 18, 2003 (JP) ..... 2003-326972

(51) Int. Cl.
*G03G 21/00* (2006.01)

(52) U.S. Cl. ..... 399/350; 399/351; 399/123

(58) Field of Classification Search ..... 399/350, 399/351, 101, 123, 162, 165
See application file for complete search history.

(56) References Cited

U.S. PATENT DOCUMENTS

| | | | | |
|---|---|---|---|---|
| 4,791,455 | A | * | 12/1988 | Yamamoto et al. |
| 5,237,377 | A | * | 8/1993 | Harada et al. |
| 5,258,816 | A | | 11/1993 | Haneda et al. |
| 5,625,443 | A | | 4/1997 | Ohta et al. |
| 5,715,513 | A | | 2/1998 | Ohta et al. |
| 6,047,157 | A | * | 4/2000 | Tatematsu et al. |
| 6,704,528 | B1 | | 3/2004 | Kawamura et al. |
| 2003/0016969 | A1 | * | 1/2003 | Sawai |
| 2003/0091373 | A1 | | 5/2003 | Abe et al. |

FOREIGN PATENT DOCUMENTS

| | | | |
|---|---|---|---|
| JP | 3-220571 | | 9/1991 |
| JP | 5-289426 | | 11/1993 |
| JP | 8-115028 | | 5/1996 |
| JP | 11-305567 | | 11/1999 |
| JP | 2000-227727 | | 8/2000 |
| JP | 2001-201993 | | 7/2001 |
| JP | 2001-343838 | | 12/2001 |
| JP | 2002-287532 | | 10/2002 |
| JP | 2003-98857 | | 4/2003 |
| JP | 2003122228 | A * | 4/2003 |

* cited by examiner

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A belt unit including an endless belt that is stretched over a plurality of rollers, a drive roller, and a tension roller. The belt unit also includes a cleaning apparatus which includes a rotary unit and a cleaning member configured to clean a surface of the endless belt. The tension roller is arranged at a position opposing the cleaning apparatus and configured to transmit a driving force to the rotary unit.

15 Claims, 11 Drawing Sheets

CLEANING APPARATUS FOR REMOVING TONER ADHERED ONTO ENDLESS BELT

CROSS-REFERENCE TO RELATED APPLICATIONS

This application is a Divisional of and claims the benefit priority from U.S. Ser. No. 10/926,180, filed Aug. 26, 2004, now U.S. Pat. No. 7,421,239 which claims the benefit of priority from Japanese Patent Application Nos. 2003-301278, filed Aug. 26, 2003 and 2003-326972, filed Sep. 18, 2003, the entire contents of each of which are incorporated herein by reference.

BACKGROUND OF THE INVENTION

1) Field of the Invention

The present invention relates to an apparatus that removes a toner on an endless belt, such as a photosensitive belt or a transfer belt, which is used in the image forming apparatuses, such as electrophotographic printers, facsimile machines, and copier.

2) Description of the Related Art

In electrophotographic image forming apparatuses, an endless belt is used as a photosensitive belt, an indirect transfer belt, a direct transfer belt, to carry a toner. Particularly, due to layout restrictions, color electrophotographing apparatuses essentially requires the provision of a plurality of developing devices and a plurality of photoconductors, so that an endless belt, not a drum type belt, is often employed in such apparatuses. From the viewpoints of achieving size reduction and cost reduction, it is inevitable in design to minimize the number of rollers on which the belt is stretched and supported.

To clean toner from an endless belt, one approach is to provide a cleaning blade that abuts the endless belt. In this case, an opposing roller which supports abutment of the cleaning blade onto the belt is arranged inward of the endless belt so that a cleaning apparatus that is arranged at the roller that support the belt in such a way as to face the belt can be realized.

One of the rollers that support the belt should obviously be a tension roller to apply tension to the belt. It is desirable that the roller for abutting the blade onto the belt should be a fixed roller, not a movable tension roller, from the viewpoint of positional precision. However, from the layout restriction of individual units to be arranged around the belt and the restriction on the position of a drive roller which stabilizes driving of the belt, in addition to the aforementioned achievement of size reduction and cost reduction, it is sometimes advantageous for an image forming apparatus or a product as a whole to arrange the cleaning apparatus at the tension roller.

Japanese Patent Application Laid-Open No. H5-289426 discloses a technique for abutting the tension roller as an opposing roller onto the blade. However, the angle of abutment of the blade onto the belt may change due to a change in the position of the tension roller depending on the rotation fulcrum position of the cleaning apparatus or the layout restriction on the pressing direction of the tension roller. When there is a large change in the angle of abutment of the blade, inadequate cleaning may occur.

SUMMARY OF THE INVENTION

It is an object of the present invention to solve at least the problems in the conventional technology.

A cleaning apparatus according to an aspect of the present invention includes a blade which abuts on an endless belt to be supported on a tension roller so as to remove a toner adhered to a surface of the endless belt; a blade holding structure that holds the blade in such a way as to be movable with respect to a direction of motion adjustment for adjusting tension on the endless belt applied by the tension roller with rotation of the blade restricted, and causes the blade to abut on a winding area of the endless belt with respect to the tension roller; and an abutment maintaining structure that allows the blade to follow up movement of the tension roller in the direction of motion adjustment to thereby maintain abutment of the blade on the endless belt.

An image forming apparatus according to an aspect of the present invention includes an endless belt that is supported on a tension roller; and the above cleaning apparatus.

The other objects, features, and advantages of the present invention are specifically set forth in or will become apparent from the following detailed description of the invention when read in conjunction with the accompanying drawings.

BRIEF DESCRIPTION OF THE DRAWINGS

FIGS. 4A and 4B are cross-sectional views along line A-A' in FIG. 3, in which FIG. 4A depicts the main unit coupled to a support shaft, and FIG. 4B depicts the main unit disconnected from the support shaft;

DETAILED DESCRIPTION

Exemplary embodiments of a cleaning apparatus according to the present invention are described below while referring to the accompanying drawings.

Figure 1:
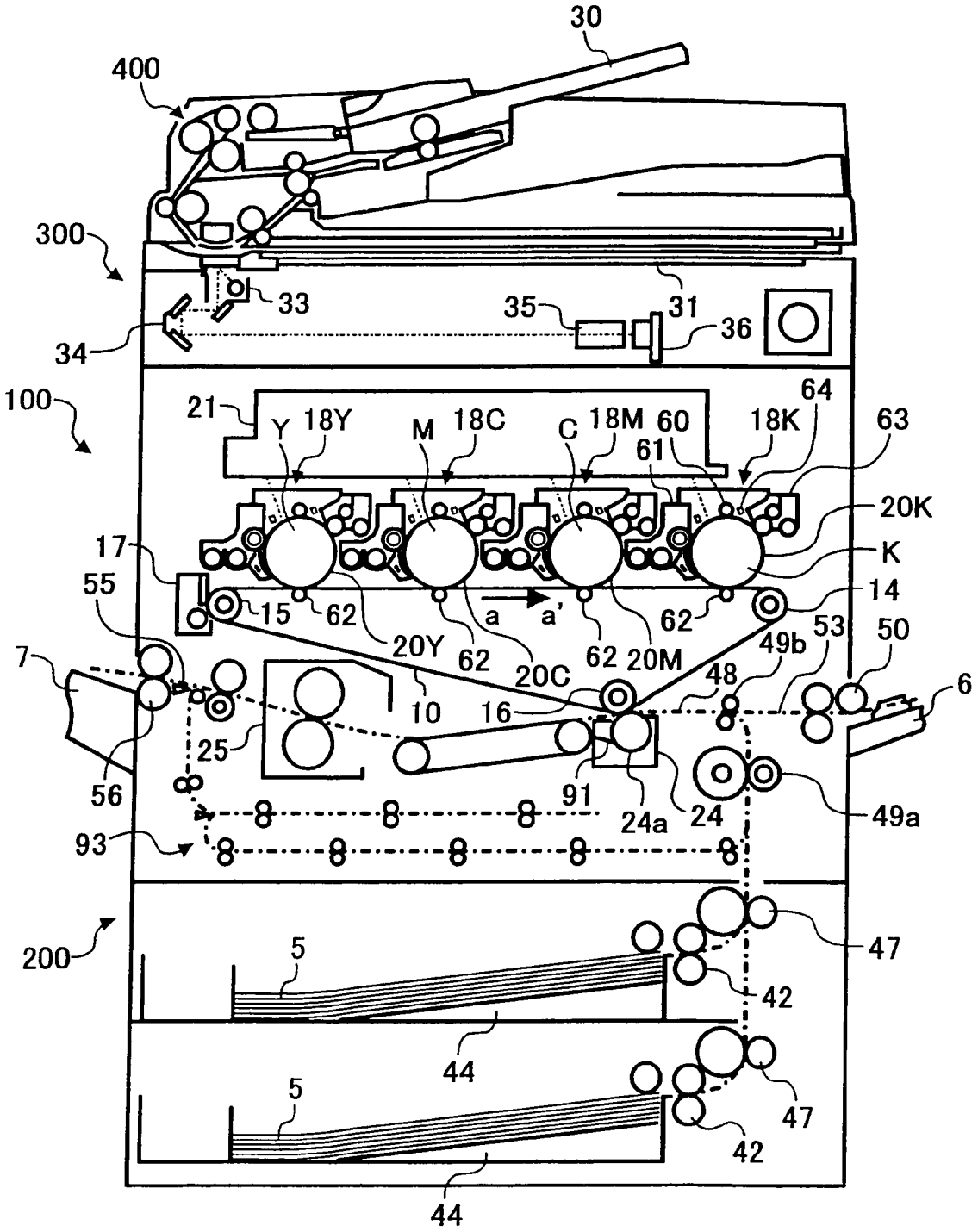
FIG. 1 is a schematic side view of a copier according to a first embodiment of the present invention.

FIG. 1 is a schematic side view of a copier according to a first embodiment of the present invention. The copier is an image forming apparatus and it is an electrophotographic tandem-type full-color copier. The image forming apparatus in which the present invention can be applied is not limited to copiers but it may be printers, facsimile machines, or the like.

The general structure of the copier shown in FIG. 1 will be explained now. The copier includes a copier main unit 100 that forms an image, a sheet feeder 200 on which the copier main unit 100 is mounted and that feeds a transfer sheet 5 as a recording medium to the copier main unit 100, a scanner 300 that scans the image of an original document placed on the copier main unit 100, and an automatic document feeder (ADF) 400 which is attached to the upper portion of the scanner 300. The copier main unit 100 is provided with a manual feed tray 6 for manually feeding the transfer sheet 5 and a discharge tray 7 on which an image-formed transfer sheet 5 is discharged.

An intermediate transfer belt 10 which is an endless belt is provided as an intermediate transfer member in the copier main unit 100. The intermediate transfer belt 10 is turned in the direction of a-a' in FIG. 1 while being stretched over three support rollers 14, 15, and 16. Of the support rollers, the support roller 15 is a tension roller for adjusting the tension of the intermediate transfer belt 10. Hereafter, the support roller 15 will be referred to as "tension roller 15" to make it's function clear.

Four image forming units 18Y, 18C, 18M, and 18K of yellow, cyan, magenta, and black are laid side by side between the first support roller 14 and the second support roller 15 of the support rollers 14, 15, and 16 where the belt is stretched. An exposure device 21 is provided above the image forming units 18Y, 18C, 18M, and 18K. The exposure device 21 drives a semiconductor laser (not shown) to emit a write light based on image information of the original document, scanned by the scanner 300, under the control of a laser controller (not shown), and forms electrostatic latent images on photosensitive drums 20Y, 20C, 20M, and 20K as image carriers provided at the respective image forming units 18Y, 18C, 18M, and 18K. The source of emitting the write light is not limited to the laser but may be a light emitting diode (LED), for example.

The structures of the image forming units 18Y, 18C, 18M, and 18K will be explained next. While the image forming unit 18K that forms a black toner image is explained below, the other image forming units 18Y, 18C, and 18M have similar structures. The image forming unit 18 is provided with a charger 60, a developing device 61, a photoconductor cleaning device 63, and a deelectrifying device 64 around the photosensitive drum 20. The charger 60 charges the top surface of the photosensitive drum 20. The developing device 61 develops the electrostatic latent image, formed on the top surface of the photosensitive drum 20 through exposure by the exposure device 21, to provide a visual toner image. The photoconductor cleaning device 63 removes and collects toners remained on the top surface of the photosensitive drum 20 after image transfer. The deelectrifying device 64 initializes the surface potential of the photosensitive drum 20 after cleaning. A first transfer device 62 is provided at the position facing the photosensitive drum 20 via the intermediate transfer belt 10.

In the image forming process, images of individual four colors are formed on the intermediate transfer belt 10 and are superimposed on one another on the intermediate transfer belt 10 to form one color image. First, a yellow (Y) toner is developed by a yellow (Y) image forming unit and is transferred onto the intermediate transfer belt 10. Next, a magenta (M) toner is developed by a magenta (M) image forming unit and is transferred onto the intermediate transfer belt 10. Then, a cyan (C) toner is developed by a cyan (C) image forming unit and is transferred onto the intermediate transfer belt 10. Finally, a black (K) toner is developed by a black (K) image forming unit and is transferred onto the intermediate transfer belt 10 by the first transfer device 62, thereby forming a full-color toner image with the four colors superimposed. Then, the toner image of four colors transferred on the intermediate transfer belt 10 is transferred onto the transfer sheet 5, fed from the sheet feeder 200, by a double transfer device 24, is fixed by a fixing device 25, and is then discharged onto the discharge tray 7 by discharge rollers 56. After the full-color toner image is transferred, the toners that remain on the top surface of the intermediate transfer belt 10 are removed and collected by the cleaning apparatus 17. The top surface of the photosensitive drum 20 is initialized by the deelectrifying device 64 to be ready for the next image formation.

The double transfer device 24 presses a secondary transfer roller 24*a* against the third support roller 16 via the intermediate transfer belt 10 to transfer the image on the intermediate transfer belt 10 onto the transfer sheet 5.

Figure 2:
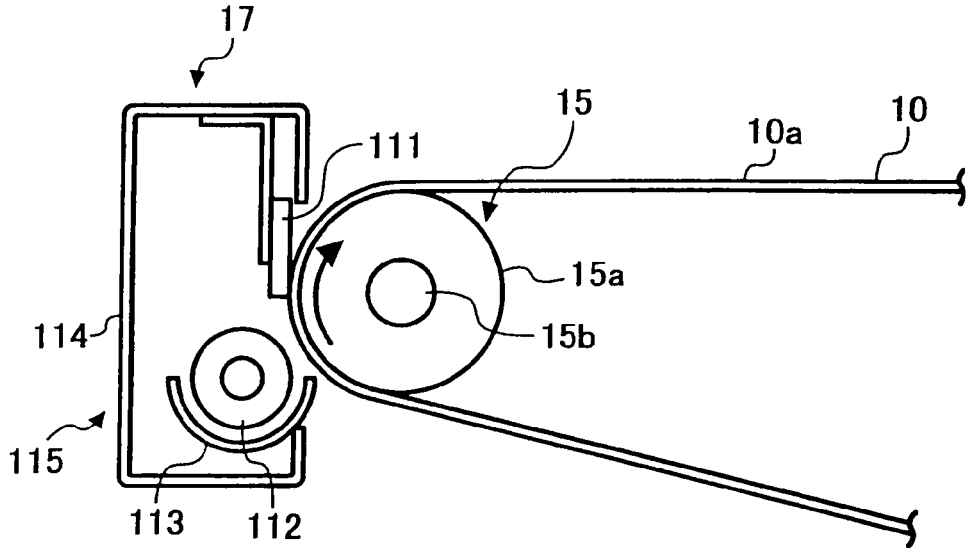
FIG. 2 is a schematic side view of a region around a cleaning apparatus according to the first embodiment.
Figure 3:
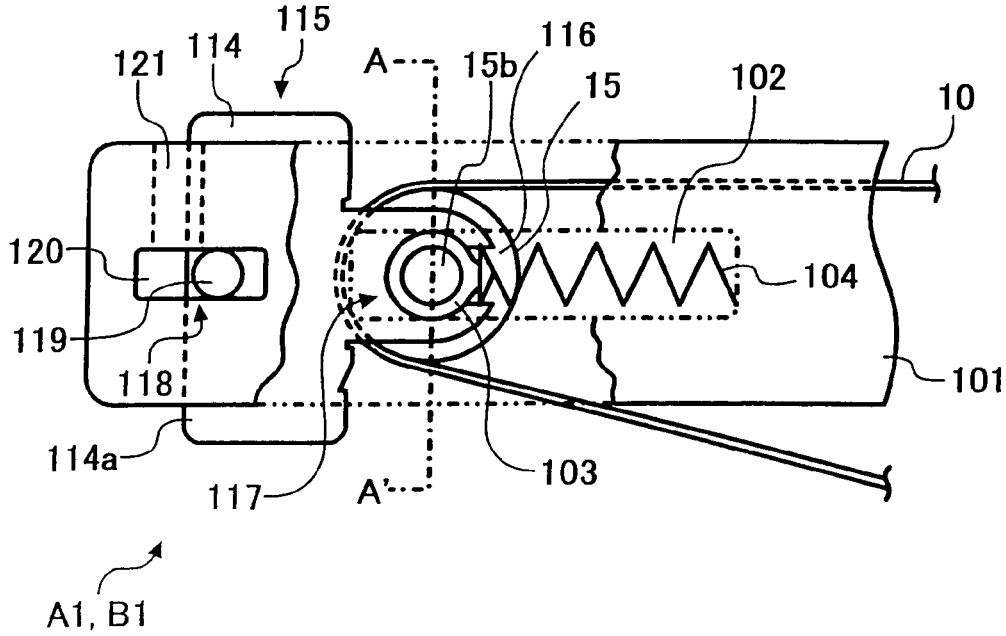
FIG. 3 is a schematic side view of a structure for holding the main unit of the cleaning apparatus and a tension roller.
Figure 4A:
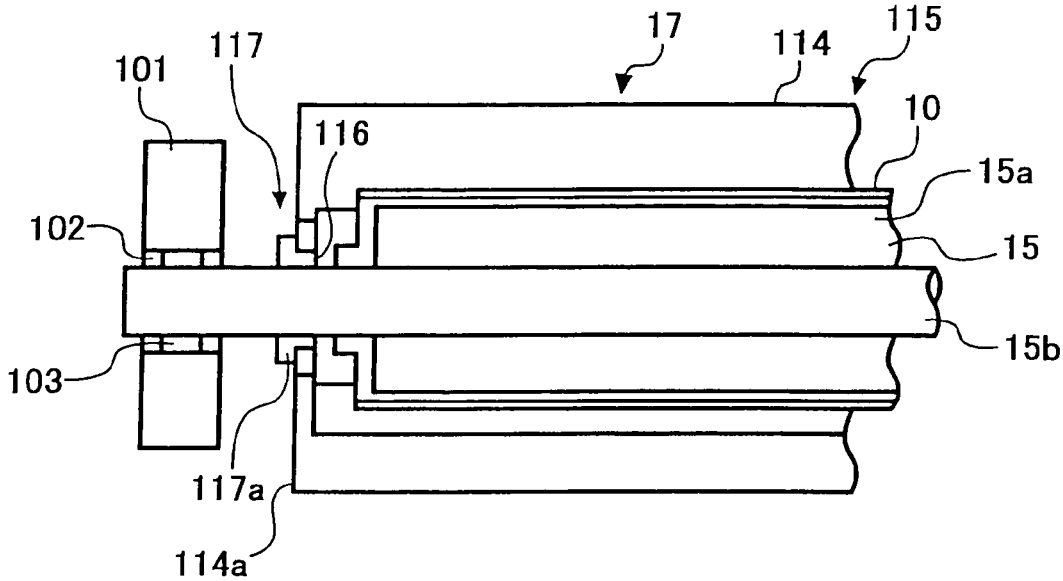
Figure 4B:
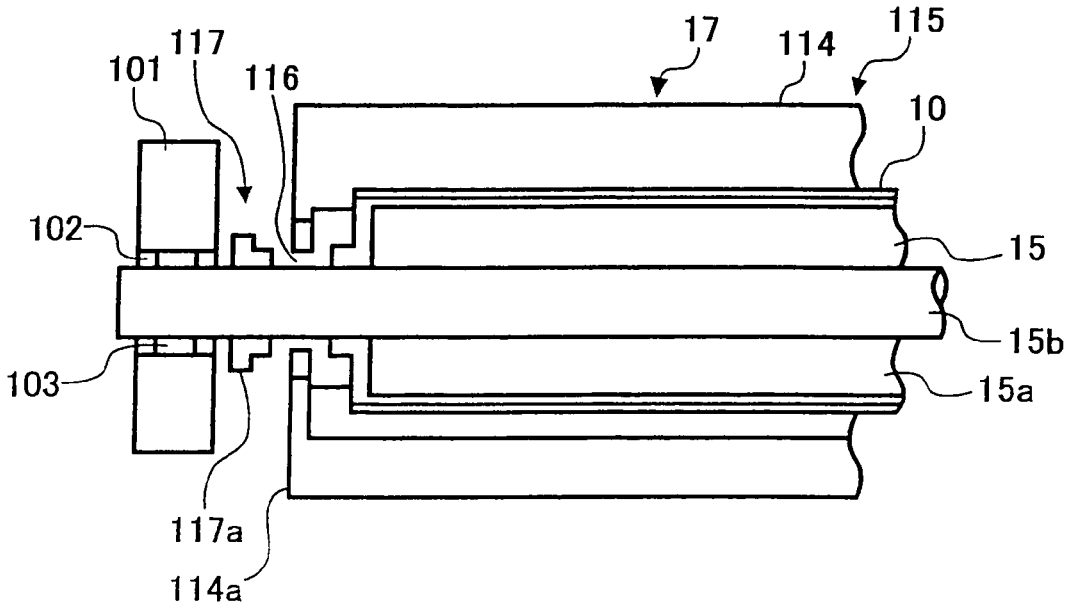

The cleaning apparatus 17 and the tension roller 15 will be explained with reference to FIGS. 2 to 4. FIG. 2 is a side view of the cleaning apparatus 17, the tension roller 15, and the intermediate transfer belt 10. FIG. 3 is a side view of a holding structure for holding the main unit of the cleaning apparatus 17 and the tension roller 15. FIGS. 4A and 4B are cross-sectional views along line A-A' in FIG. 3, in which FIG. 4A depicts the main unit coupled to a support shaft, and FIG. 4B depicts the main unit disconnected from the support shaft.

As shown in FIG. 2, the cleaning apparatus 17 is arranged at the position opposing the tension roller 15. The tension roller 15 includes a roller portion 15*a* and a support shaft 15*b* secured to the roller portion 15*a*, and is so attached as to apply tension to the intermediate transfer belt 10. As shown in FIGS. 3 and 4, the tension roller 15 has both ends of the support shaft 15*b* slidably held in elongated holes 102 formed in a pair of side plates 101 (only one side plate 101 is shown in the diagrams) which are roller support members. Specifically, bearings 103 are provided at both ends of the support shaft 15*b* and are slidably fitted in the elongated holes 102. The sliding direction in the elongated hole 102 is set to the direction of motion adjustment in which the tension roller 15 adjusts the tension on the intermediate transfer belt 10. As coil springs 104 which are provided in the elongated holes 102 to serve as compression springs press the tension roller 15 via the bearings 103 in the pressurizing direction in the direction of motion adjustment which applies tension to the intermediate transfer belt 10, the tension roller 15 applies tension to the intermediate transfer belt 10. The pair of side plates 101 is secured to the casing of the copier main unit 100.

As shown in FIG. 2, the cleaning apparatus 17 has a blade 111 which abuts on the outer surface 10*a*, of the intermediate transfer belt 10 to remove toners off the outer surface 10*a*, and a toner collecting unit 113 that collects the toners removed by the blade 111 and discharges the toners to a discharged-toner delivering path, not shown, provided at the copier main unit 100 by a toner delivering screw 112. The blade 111 and the toner collecting unit 113 are attached to a box-like case 114 which is a blade holding member. The blade 111, the toner collecting unit 113, and the case 114 constitute a main unit 115.

The blade 111 is attached in such a way as to abut on the winding area in the intermediate transfer belt 10 which corresponds to the tension roller 15, and scrapes the toners off from the outer surface 10*a* of the intermediate transfer belt 10 as the intermediate transfer belt 10 is turned. The residual toners on the intermediate transfer belt 10 include, for example, a toner remained after transfer, a toner to be formed as an image pattern for feedback control to check the running state of the intermediate transfer belt 10 and align the individual colors, and a toner to be formed as an image pattern for controlling the amount of toners adhered onto the intermediate transfer belt 10.

The holding structure for the main unit 115 of the cleaning apparatus 17 will be explained next. As shown in FIGS. 3 and 4, notches 116 of such a size as to permit the ends of the support shaft 15*b* to come in and out are formed in both side walls 114*a* of the case 114 (only one side wall 114*a* is shown in the diagrams). Bearings 117*a* are fitted over both ends of the support shaft 15*b* of the tension roller 15 in such a way as to be slidable in the axial direction. The bearings 117*a* are so formed as to be engageable with and disengageable from the notches 116 in the axial direction of the support shaft 15*b*. As the bearings 117*a* are fitted in the notches 116 with the support shaft 15*b* inserted in the notches 116, therefore, the main unit 115 is attached to the support shaft 15*b* of the tension roller 15. The notches 116 and the bearings 117*a* constitute a coupling unit 117. In this state, the tension roller 15 and the cleaning apparatus 17 are positioned at one point, and the main unit 115 has some degree of freedom in the rotational direction about the support shaft 15*b* of the tension roller 15. In this respect, a positioning unit 118 is provided to restrict the degree of freedom.

As shown in FIG. 3, the positioning unit 118 is constituted as projections 119 or fitting portions formed protruding outward from both side walls 114*a* of the case 114 are slidably fitted in elongated holes 120 formed in both side plates 101. The sliding direction is identical to the direction of motion adjustment.

The positioning unit 118 positions the main unit 115 at two points, thus restricting the rotational movement of the main unit 115. The holding structure and the case 114 constitute a blade holding structure A1.

With the structure, the main unit 115 allows the blade 111 to keep abutting on the intermediate transfer belt 10 and follow up the movement of the tension roller 15 in the direction of motion adjustment which is originated from the pressure applied to the intermediate transfer belt 10. That is, the blade holding structure A1 constitutes an abutment maintaining structure B1.

Formed in the upper side of the pressurizing-side end portion of the elongated hole 120 where the projection 119 is fitted is an open portion 121 which opens the upper side. As the bearing 117*a* is disengaged from the notch 116 (see FIG. 4B) and the main unit 115 is retreated from the intermediate transfer belt 10 and lifted upward, the projection 119 passes through the open portion 121 to be disengaged from the elongated hole 120. As a result, the main unit 115 is detached from the side plates 101 and the support shaft 15*b*. Through the reverse procedures, the main unit 115 is attached to the side plates 101 and support shaft 15*b*. The main unit 115 is detachably attached to the side plates 101 which are roller support members in this manner.

The support shaft 15*b* of the tension roller 15 is secured to the roller portion 15*a* and integrated with the roller portion 15*a* in the first embodiment. As another example, however, the support shaft 15*b* may be coupled to the roller portion 15*a* via a bearing (not shown) so that the roller portion 15*a* rotates about the support shaft 15*b* while the support shaft 15*b* is made unrotatable with respect to the side plates 101.

The copier main unit 100 is provided with a feed path 48 which guides the transfer sheet 5, fed out from the sheet feeder 200, to the discharge tray 7 via the secondary transfer roller 24*a*. Various rollers, such as feed rollers 49*a*, resist rollers 49*b*, and the discharge rollers 56, are provided along the feed path 48 to allow the transfer sheet 5 to be conveyed. A changeover claw 55 which changes the feeding direction of the transfer sheet 5 after image transfer toward the discharge tray 7 or a sheet inverting device 93 is provided at the downstream side of the feed path 48. The sheet inverting device 93 inverts the transfer sheet 5 and feeds it out again toward the secondary transfer roller 24*a*. Accordingly, images can be formed on both sides of the transfer sheet 5. Further, the copier main unit 100 is provided with a manual feed path 53 which extends from the manual feed tray 6 and merges into the feed path 48. A sheet feeding unit 50 that feeds the transfer sheets 5, set on the manual feed tray 6, one by one is provided at the upstream side of the manual feed path 53.

The sheet feeder 200 includes a plurality of sheet feeding cassettes 44 each retaining the transfer sheet 5, sheet feeding units 42 that feed transfer sheets, retained in the sheet feeding cassettes 44, one by one, and feed rollers 47 for conveying the fed-out transfer sheets along a sheet feed path 46. The sheet feed path 46 is connected to the feed path 48 of the copier main unit 100.

In the scanner 300, first and second moving units 33 and 34 on each of which a document illumination light source and a mirror are mounted reciprocate in order to scan an original document (not shown) to be placed on a contact glass 31. An image forming lens 35 focuses image information, scanned by the first and second moving units 33 and 34, onto the image forming surface of a read sensor 36 placed at the back of the image forming lens 35 and is read as an image signal by the read sensor 36.

With such structure, an image forming operation is executed and as the intermediate transfer belt 10 is turned, the outer surface 10*a* of the intermediate transfer belt 10 is cleaned with the blade 111 of the cleaning apparatus 17. When the tension roller 15 is moved in the direction of motion adjustment to adjust the tension on the intermediate transfer belt 10, the main unit 115 follows up the movement of the tension roller 15 in the direction of motion adjustment with respect to the intermediate transfer belt 10 while keeping the blade 111 abutting on the intermediate transfer belt 10 as mentioned above. As the rotational movement of the main unit 115 is restricted by the positioning unit 118, the blade 111 does not rotate with respect to the tension roller 15 and the intermediate transfer belt 10. Accordingly, the position of the blade 111 with respect to the intermediate transfer belt 10 is maintained unchanged. The positional relationship between the blade 111 and the tension roller 15 significantly affects the cleanability. This is because the angle of contact and the abutting pressure of the distal edge portion of the blade 111 are major factors to determine the cleanability. In the first embodiment, the position of the blade 111 with respect to the intermediate transfer belt 10 is maintained, and the angle of contact and the abutting pressure of the distal edge portion of the blade 111 therewith are maintained, so that a stable positional precision of the blade 111 can be acquired. This maintains the stable abutment of the blade 111, thereby ensuring the cleanability with respect to the intermediate transfer belt 10.

As the tension roller 15 is designed as a roller facing the blade 111, the degree of freedom on layout is improved, contributing to size reduction and cost reduction of the apparatus.

As the main unit 115 is detachably attached to the side plates 101, the attachability, the inspectability, and the maintenanceability of the main unit 115 are high. Further, the main unit 115 of the cleaning apparatus 17 can be detached from the tension roller 15 and the side plates 101 without detaching the tension roller 15 from the side plates 101 as the roller support members, thus facilitating the detachment of the main unit 115.

Although the intermediate transfer belt 10 is taken as an endless belt, the endless could be some other belt. For example, the endless belt could be a photosensitive belt or a direct transfer belt.

Figure 5:
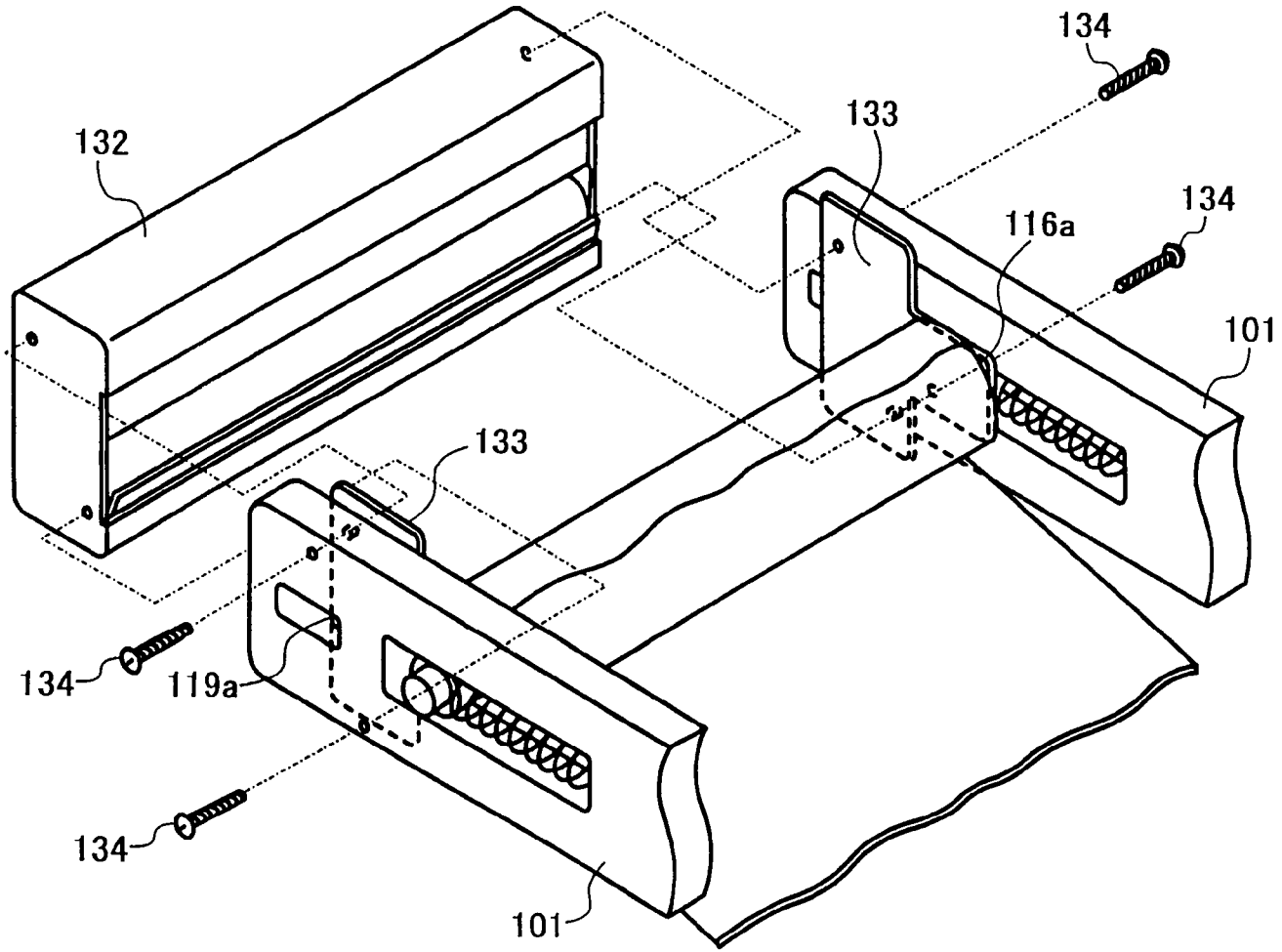
FIG. 5 is an exploded perspective view of a region around a cleaning apparatus according to a second embodiment of the present invention.

FIG. 5 is an exploded perspective view of a cleaning apparatus, a tension roller, and an intermediate transfer belt according to a second embodiment. In the first embodiment, the notches 116 and the projections 119 are provided at the side walls 114*a* of the case 114 of the main unit 115. In the second embodiment, however, notches 116*a* and projections 119*a* are provided not at a main unit 132 but at a pair of side plates 133 which are provided as separate from the main unit 132 as shown in the diagram.

The side plates 133 are first attached to the side plates 101 beforehand. The attaching method here is the same as that for the case 114 according to the first embodiment. As the main unit 132 is fitted between the pair of side plates 133, the side plates 101, the side plates 133, and the main unit 132 are secured integrally by screws 134.

As the structure does not have the projections 119 and notches 116 in the main unit 132, the safety at the time of handling the main unit 132 detached from the side plates 101 is improved.

Figure 6:
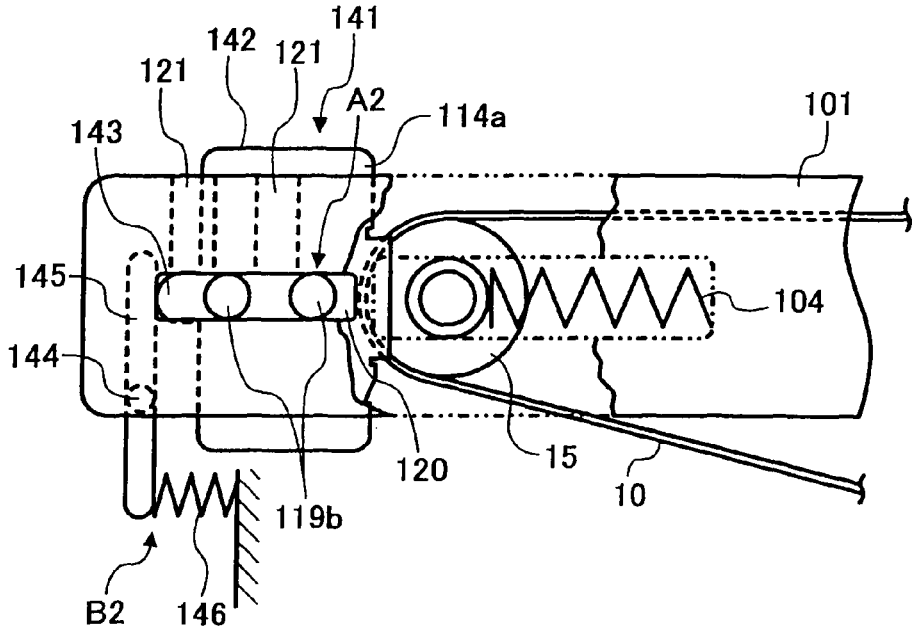
FIG. 6 is a schematic side view of a structure for holding a main unit of a cleaning apparatus, and a tension roller according to a third embodiment of the present invention.

FIG. 6 is a schematic structural diagram of a holding structure for the main unit 142 of a cleaning apparatus 141, and a tension roller according to a third embodiment. The third embodiment differs from the first embodiment in a blade holding structure A2 and an abutment maintaining structure B2 of the cleaning apparatus 141.

The blade holding structure A2 will be explained below. As shown in FIG. 6, the notches 116 are not provided at both side walls 114*a* (only one side wall 114*a* is shown in the diagram) of the main unit 142 according to the third embodiment. Two projections 119*b* formed protruding outward are provided at both side walls 114*a* of the case side by side in the direction of motion adjustment and are slidably fitted in the elongated holes 120 formed in both side plates 101. The sliding direction is the same as the direction of motion adjustment. The structure restricts the rotational movement of the main unit 142.

The abutment maintaining structure B2 will be explained below. Projections 143 are formed at the back of the case of the main unit 142. The upper end of a lever 145 which rotates about a support shaft 144 abuts on the projection 143. The lower end of the lever 145 is urged in the same direction as the pressurizing direction of the tension roller 15 by a coil spring 146 which serves as urging means and as a compression spring. Accordingly, the upper end of the lever 145 presses the projection 143 in the opposite direction to the pressurizing direction of the tension roller 15 or toward the tension roller 15, thus urging the main unit 142 toward the intermediate transfer belt 10, so that the blade 111 abuts on the intermediate transfer belt 10.

With such structure, the main unit 142 follows up the movement of the tension roller 15 in the direction of motion adjustment caused by the pressurization of the tension roller 15 on the intermediate transfer belt 10 while keeping the blade 111 abutting on the intermediate transfer belt 10. As the rotational movement of the main unit 142 is restricted, the blade 111 does not rotate with respect to the tension roller 15 and the intermediate transfer belt 10. Accordingly, the position of the blade 111 with respect to the intermediate transfer belt 10 is maintained.

Figure 7:
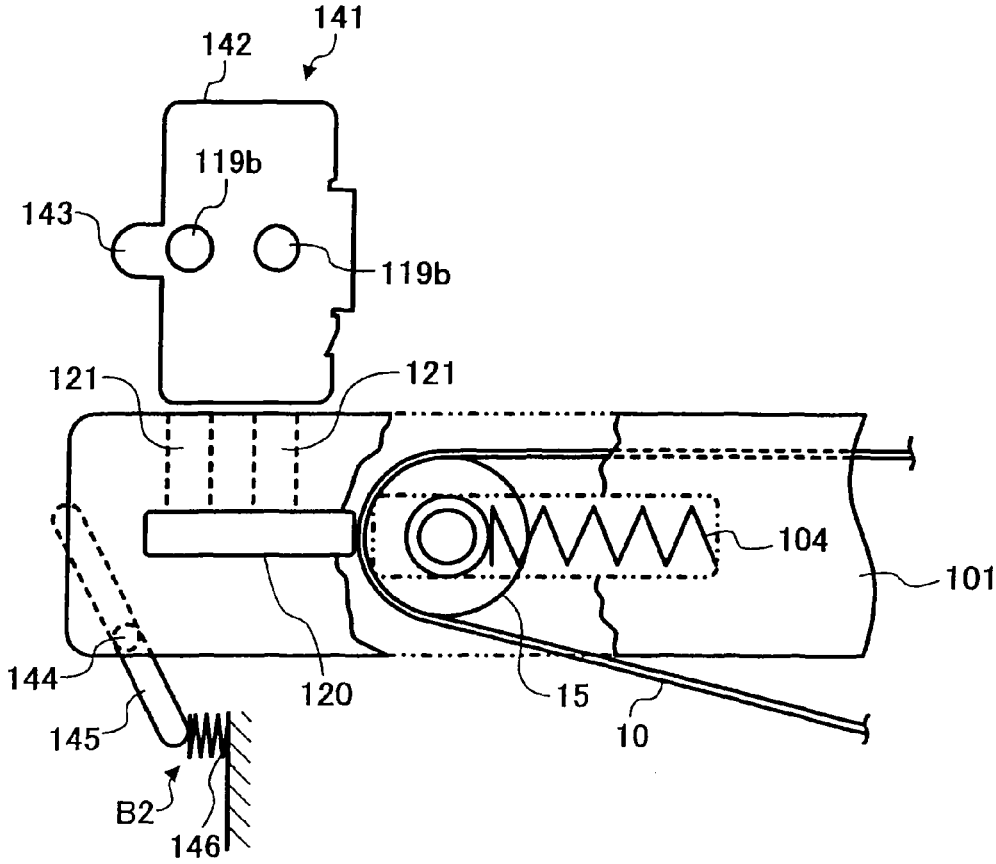
FIG. 7 is a side view of a state in which the main unit of the cleaning apparatus according to the third embodiment is detached.

The open portions 121 respectively corresponding to the projections 119*b* are formed in the elongated holes 120 where the projections 119*b* are fitted. Accordingly, as the lever 145 is turned in the cancel direction for canceling the urging of the coil spring 146 on the main unit 142 to cancel the urging of the coil spring 146, and the main unit 142 is retreated from the intermediate transfer belt 10 and lifted upward, the projections 119*b* are disengaged from the open portions 121. FIG. 7 is an explanatory diagram of the main unit 142 of a cleaning apparatus 141 according to the third embodiment detached. The main unit 142 is detached from the side plates 101 in this manner.

To attach the main unit 142 to the side plates 101, the lever 145 is turned in the cancel direction and the projections 119 are fitted in the elongated holes 120 after which the lever 145 is released, causing the main unit 142 to move toward the intermediate transfer belt 10 due to the urging force of the coil spring 146 so that finally the blade 111 abuts on the intermediate transfer belt 10 to be positioned. This completes the attachment of the blade 111 to the intermediate transfer belt 10 (see FIG. 6). In this manner, the main unit 142 is detachably attached to the side plates 101 which are roller support members.

Such structure can maintain the position of the blade 111 with respect to the intermediate transfer belt 10, and maintain the angle of contact and the abutting pressure of the blade 111 with respect to the intermediate transfer belt 10, so that a stable positional precision of the blade 111 can be acquired. This can keep the stable abutment of the blade 111, thereby making it possible to ensure the cleanability with respect to the intermediate transfer belt 10.

Figure 8:
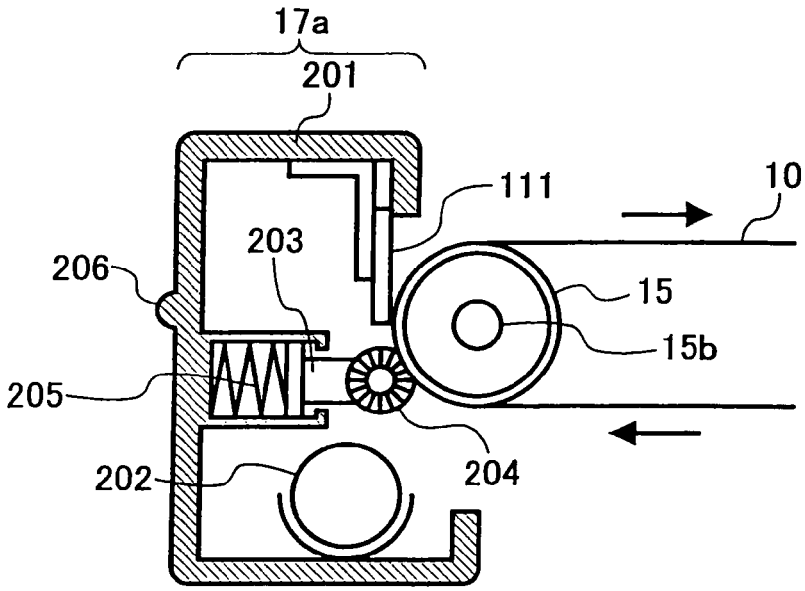
FIG. 8 is a cross-sectional view of a belt unit that includes a cleaning apparatus and an intermediate transfer member according to a fourth embodiment of the present invention.

FIG. 8 is a cross-sectional view of a belt unit that includes a cleaning apparatus 17*a* and an intermediate transfer belt 10 according to a fourth embodiment. The mechanism that drives the cleaning apparatus according to the fourth embodiment can be adapted in general to a belt-like image carrier such as a direct transfer belt or a belt-like photoconductor, as well as an intermediate transfer member like the intermediate transfer belt.

The blade 111 is supported at the opening of a case 201 and the distal end of the blade 111 abuts on the outer surface of the intermediate transfer belt 10. Further, a toner delivering screw (rotary unit) 202 that catches and conveys toners which are scraped off and dropped is arranged under the case 201.

The roller on which the blade 111 abuts via the intermediate transfer belt 10 is the tension roller 15 for applying the proper tension to the intermediate transfer member. The positional relationship between the blade 111 and the tension roller 15 greatly affects the cleanability. This is because the positional relationship influences the cleaning angle and the abutting pressure of the distal edge portion of the blade 111.

Cleaning is generally performed by scraping toner images off using a blade, a brush, and the like from an image carrier, such as the intermediate transfer belt, the direct transfer belt, and the photoconductor. When those schemes cannot provide sufficient cleanability, however, it is effective to whittle a solid lubricant (remover) 203, such as zinc stearate, compressed by a spring 205 or the like, into powder with a brush roller 204 or the like, and apply the powder to the top surface of the image carrier beforehand as shown in FIG. 8, thereby reducing the adhesion of toners and improving the cleanability. High cleanability is required for polymeric toners so that attention is paid to a lubricant application system. In other words, even with the use of polymeric toners which are generally considered hard to be cleaned, the effect of the remover can improve the cleaning performance.

Although the brush roller (fur brush roller or sponge roller) 204 as a rotary unit is driven by the tension roller in the fourth embodiment, the brush roller may be driven by a driver roller or an endless belt.

Figure 9:
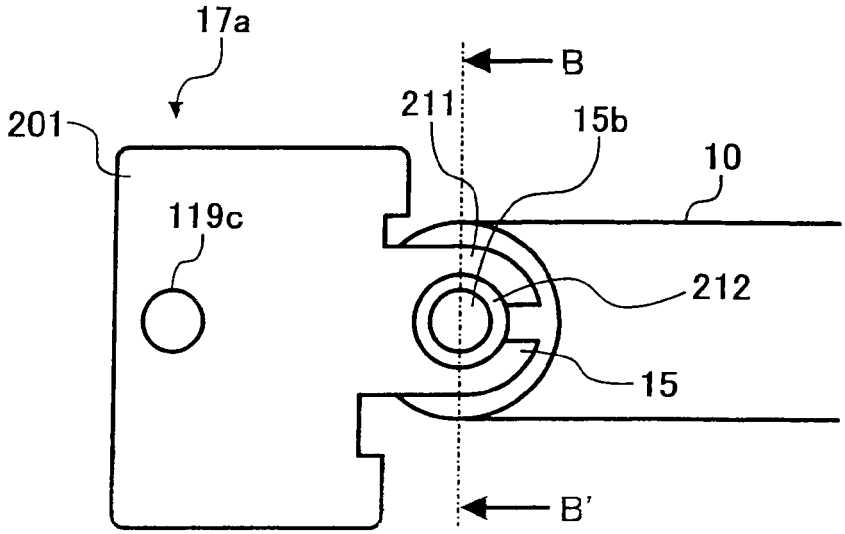
FIG. 9 is an external view of a case of the cleaning apparatus according to the fourth embodiment.

FIG. 9 is an external view of a case 201 of the cleaning apparatus 17*a*. The case has an inner side portion (not shown) which carries the bearing to rotatably support the brush roller 204 and the toner delivering screw 202 as shown in FIG. 8, and a gear to drive each rotary unit is attached inside the case 201 (not shown). A cutaway portion is provided at the end portion of a positioning unit 211 with an approximately C shape, which protrudes toward the tension roller 15 from the case 201. As the shaft 15*b* of the tension roller 15 is fitted in the cutaway portion and a bearing member 212 is then fitted over the shaft 15*b*, the positioning unit 211 and the shaft 15*b* of the tension roller 15 are positioned.

Figure 10:
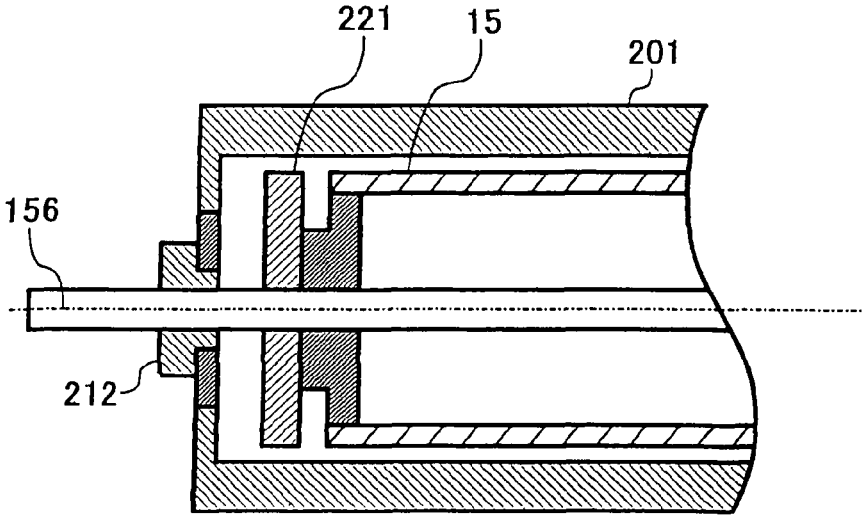
FIG. 10 is a cross-sectional view along line B-B' in FIG. 9.

FIG. 10 is a cross-sectional view along line B-B' in FIG. 9. A drive gear 221 which is attached to one end of the tension roller 15 in the case 201 rotates together with the tension roller 15. By setting a cleaning apparatus 17*a*, the drive gear 221 engages with a gear provided at the shaft of the brush roller 204. This allows the driving force to be transmitted from the tension roller 15 to the brush roller 204 of the cleaning apparatus 17*a*. The gear of the toner delivering screw 202 that is engaged with the gear of the brush roller 204 also transmits the driving force to the toner delivering screw 202. The axially opposite end face of the cleaning apparatus 17*a* is positioned in a similar way except that the end face is not provided with a drive gear.

In this state, the tension roller 15 and the cleaning apparatus 17*a* are positioned at one point in FIG. 9, and the cleaning apparatus 17*a* has some degree of freedom in the rotational direction about the core shaft of the tension roller 15. Projections 119*c* which serve as positioning to restrict the degree of freedom are provided at the same positions on both sides of the case 201 of the cleaning apparatus 17*a*.

Figure 11:
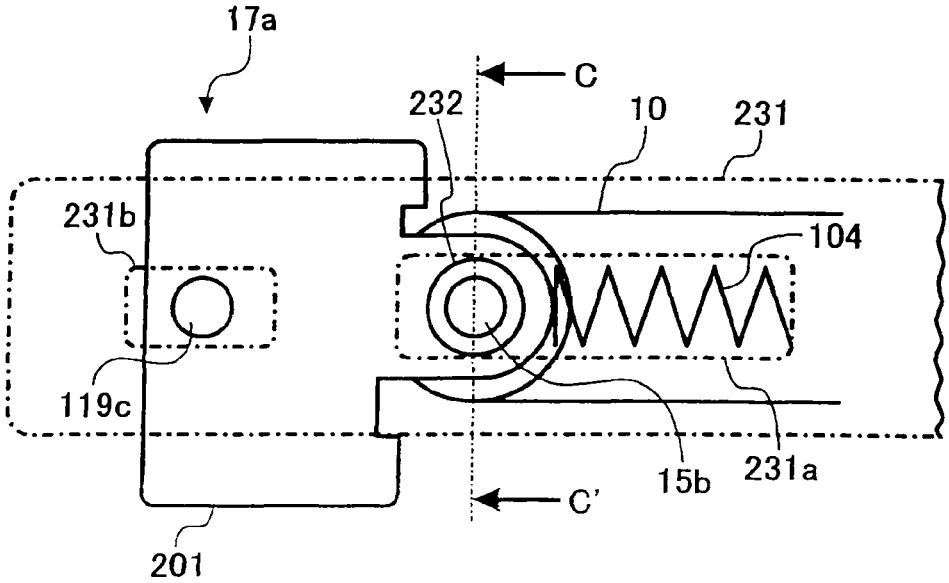
FIG. 11 is an enlarged view of essential portions depicting a support structure for a tension roller and the cleaning apparatus according to the fourth embodiment, which is constituted by a side plate of the main unit of the cleaning apparatus.

FIG. 11 is an enlarged view of essential portions depicting a support structure for a tension roller and the cleaning apparatus, which is constituted by a side plate of the main unit of the cleaning apparatus. Referring to the diagram, guide grooves 231*a* which position bearings 232 of the tension roller 15 in the pressurizing direction by the coil springs 104 are provided at side plates 231 to be a support casing of the intermediate transfer belt 10. Parallel guide grooves 231*b* are provided at the positions extending from the guide grooves 231*a*, in which the projections 119*c* of the cleaning apparatus 17*a* are to be fitted.

Figure 12:
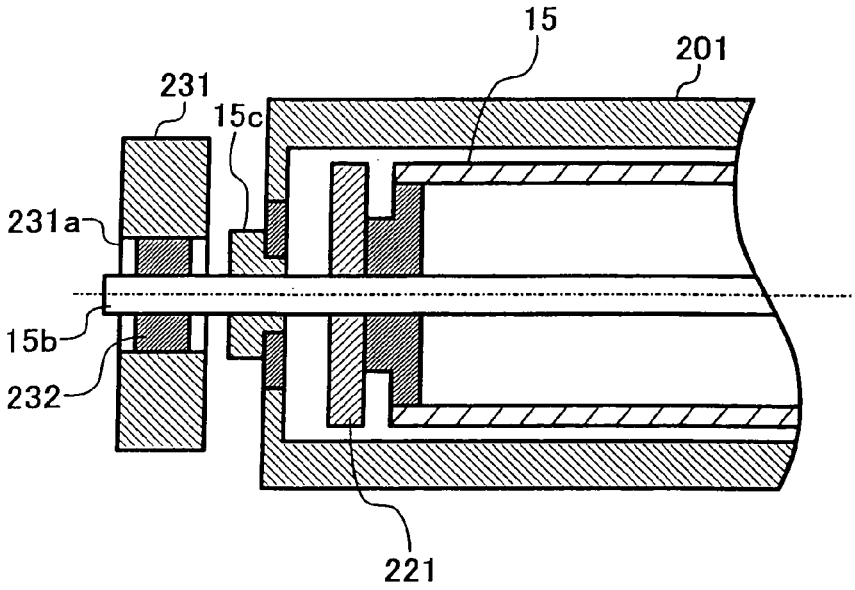
FIG. 12 is a cross-sectional view along line C-C' in FIG. 11.

FIG. 12 is a cross-sectional view along line C-C' in FIG. 11, depicting the cross section of the tension roller 15. The opposite end face of the cleaning apparatus 17*a* is positioned with a similar structure except that the end face is not provided with a gear. Although the shaft 15*b* of the tension roller 15 at both ends is integrated with the tension roller 15 in the example in the drawing, a flange 15*c* in FIG. 12 may be designed into a bearing structure and the portion 15*b* may be designed as a non-rotatable shaft while the other portion is made rotatable.

The cleaning apparatus 17*a* is positioned with the tension roller 15 via the side plates 231, so that the cleaning apparatus 17*a* follows up with the pressurization-oriented movement of the tension roller 15. Therefore, the driving force generated by the rotation of the tension roller 15 is transmitted to the brush roller 204 via the drive gear 221, then to the toner delivering screw 202.

Since the driving force of the rotary unit, such as the brush roller 204 or the toner delivering screw 202, is acquired from the drive roller which is not likely to affect the running of the endless belt and the tension roller 15 or the endless belt near the tension roller 15 in the fourth embodiment, the degree of freedom on layout is improved, contributing to size reduction and cost reduction of the apparatus.

Figure 13:
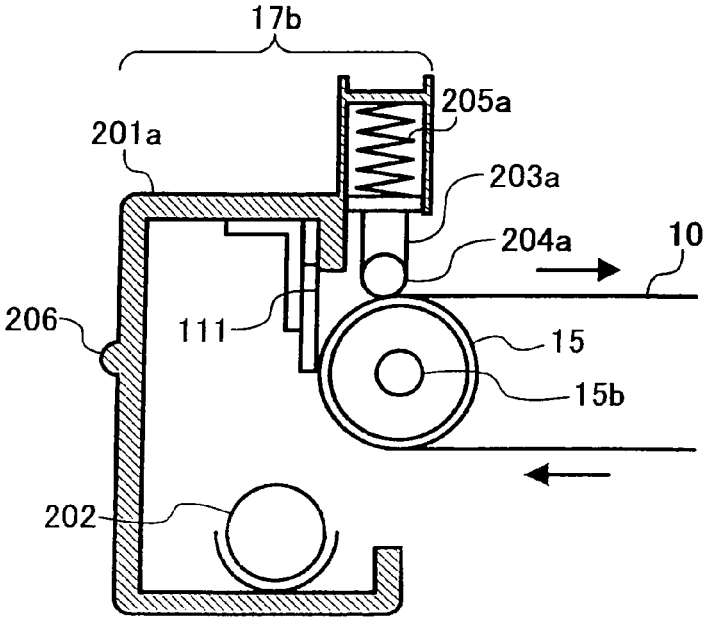
FIG. 13 is a cross-sectional view of the cleaning apparatus according to variation of the fourth embodiment.

A cleaning apparatus 17*b*, which is a variation of the cleaning apparatus 17*a*, can be attached in a different manner. FIG. 13 is a cross-sectional view of the cleaning apparatus 17*b*. The residual toner on the transfer sheet, which is adhered to the intermediate transfer member (belt) 10, and the reference image for the running state of the intermediate transfer member and alignment of individual colors are cleaned off from the intermediate transfer belt 10 by the blade 111. The toners cleaned with the blade 111 fall and are conveyed to the discharged-toner delivering path in the apparatus by the toner delivering screw 202 provided in a case 201*a* of the cleaning apparatus 17*b*. The roller on which the blade 111 is abutting via the intermediate transfer belt 10 is the tension roller for applying the proper tension to the intermediate transfer member. When sufficient cleanability is not provided, however, a lubricant 203*a*, such as zinc stearate, compressed by a spring 205*a* or the like, is whittled into powder with a brush roller 204*a* and is applied to the top surface of the image carrier.

Figure 14:
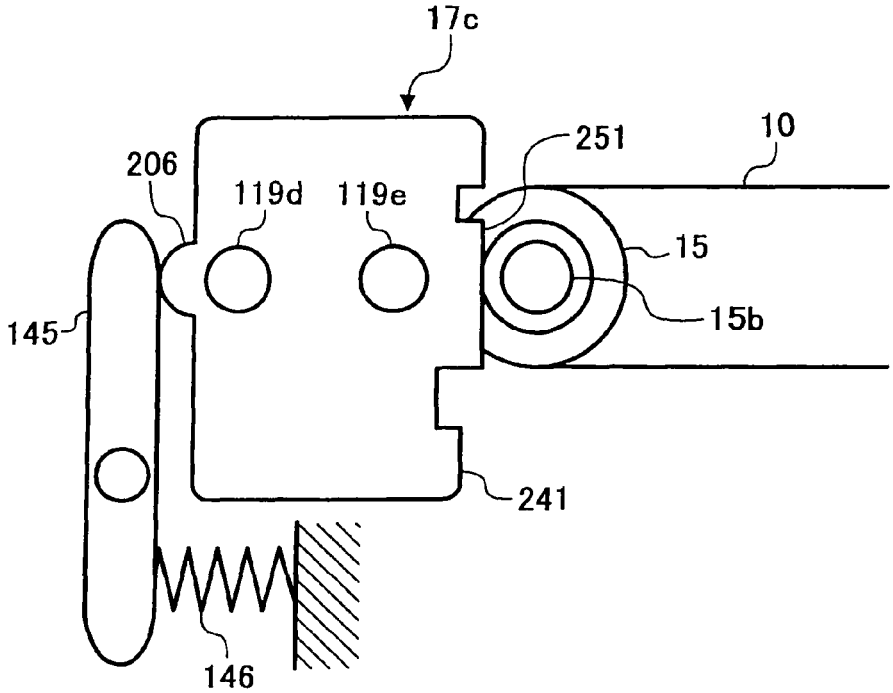
FIG. 14 is an external view of a case of a cleaning apparatus according to a fifth embodiment of the present invention.

FIG. 14 is an external view of a case 241 of a cleaning apparatus 17*c* according to a fifth embodiment. Projections 119*d* and 119*e* for positioning are respectively provided at the same positions at both sides of a case 241 of the cleaning apparatus 17*c*. The lever 145, which is rotatably supported at the fixing portion of the main unit of the cleaning apparatus 17*c* as a whole, is urged by the coil spring 146 having one end supported at the fixing portion of the apparatus's main unit, thereby pressurizing the projections 143 of the case 241. By setting the cleaning apparatus 17*c*, the brush roller 204 in the cleaning apparatus 17*c* contacts the intermediate transfer belt 10 and rolls as the intermediate transfer belt 10 runs, so that the lubricant 203 is applied to the brush roller 204.

Figure 15:
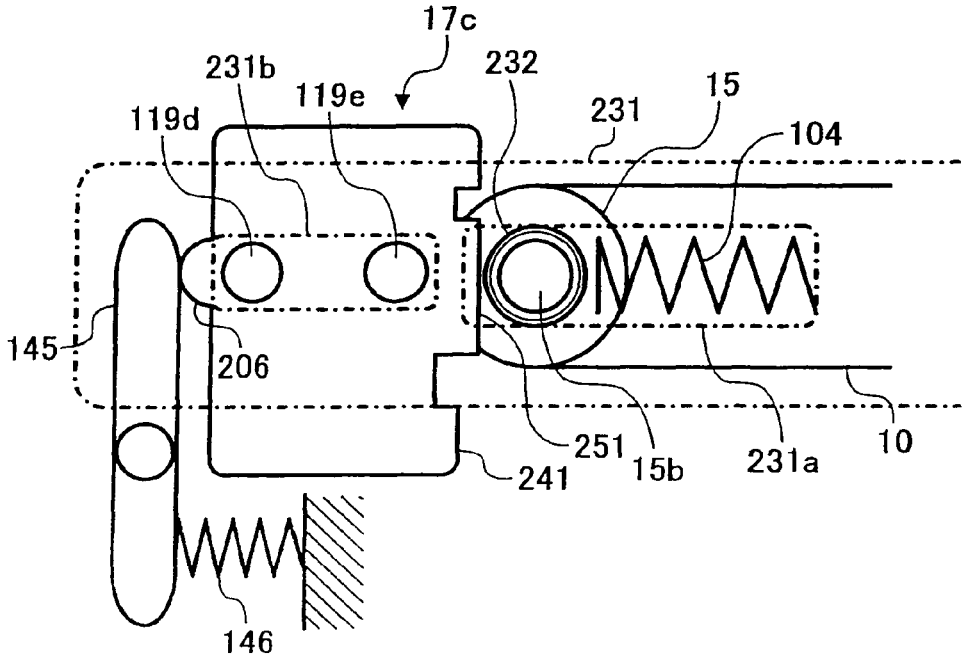
FIG. 15 depicts a state in which the cleaning apparatus according to the fifth embodiment is supported by side plates.

FIG. 15 depicts a state in which the cleaning apparatus 17*c* according to the fifth embodiment is supported by side plates. The bearing 232 of the tension roller 15 and the coil spring 104 which urges and positions the bearing 232 in the pressurizing direction are arranged in the guide grooves 231*a* provided at the side plates 231 of the casing that supports the intermediate transfer belt 10.

Parallel guide grooves 231*b* are provided at the positions extending from the guide grooves 231*a*, in which the projections 119*d* and 119*e* of the cleaning apparatus 17*c* are to be fitted. The lever 145 pressurizes the whole cleaning apparatus 17*c* in the direction parallel to the guide grooves 231*a* and 231*b* and opposite to the pressurizing direction of the coil spring 104. A positioning unit 251 which is constituted by a part of the case 241 contacts the outer surface of the bearing 232 set coaxial with the tension roller 15, thus positioning the tension roller 15 and the cleaning apparatus 17*c*. The opposite end face of the cleaning apparatus 17*c* is positioned with a similar structure.

The cleaning apparatus 17*c* is positioned with the tension roller 15 in this manner, so that the cleaning apparatus 17*c* follows up with the pressurization-oriented movement of the tension roller 15. As the intermediate transfer member runs, therefore, the lubricant feeding roller (brush roller) 204 rolls and is applied with the lubricant.

The state of the attachment of the cleaning apparatus 17*c* will be explained in detail. First, a cutaway portion is provided at the positioning unit 211 of the cleaning apparatus 17*c* and is positioned with the tension roller 15 via the bearing member 212 as in the fourth embodiment shown in FIG. 9. With this structure, by detaching the bearing member 212, the cleaning apparatus 17*c* can be separated from the tension roller 15.

Figure 16:
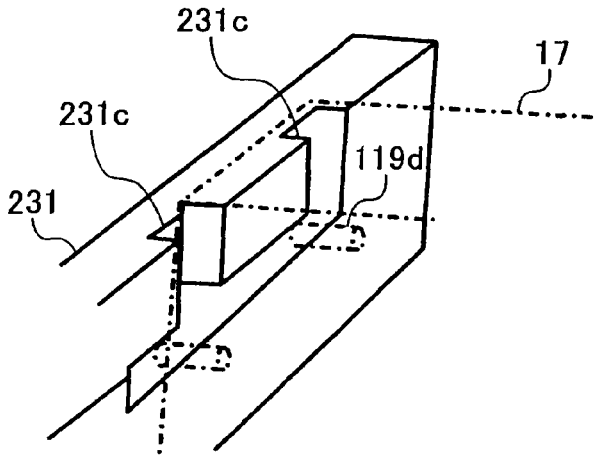
FIG. 16 is a perspective view of a guide groove in the side plate in which the projection of the cleaning apparatus according to the fifth embodiment is fit.

In the fifth embodiment, by releasing the lever 145, the cleaning apparatus 17*c* is retreated from the tension roller 15 as in the third embodiment shown in FIG. 7. Then, when the lever 145 is lifted upward, the cleaning apparatus 17*c* can be detached easily. FIG. 16 is a perspective view of guide grooves 231*c* in the side plates 231 in which the projections 119*d* and 119*e* of the cleaning apparatus 17*c* are fitted.

Figure 17:
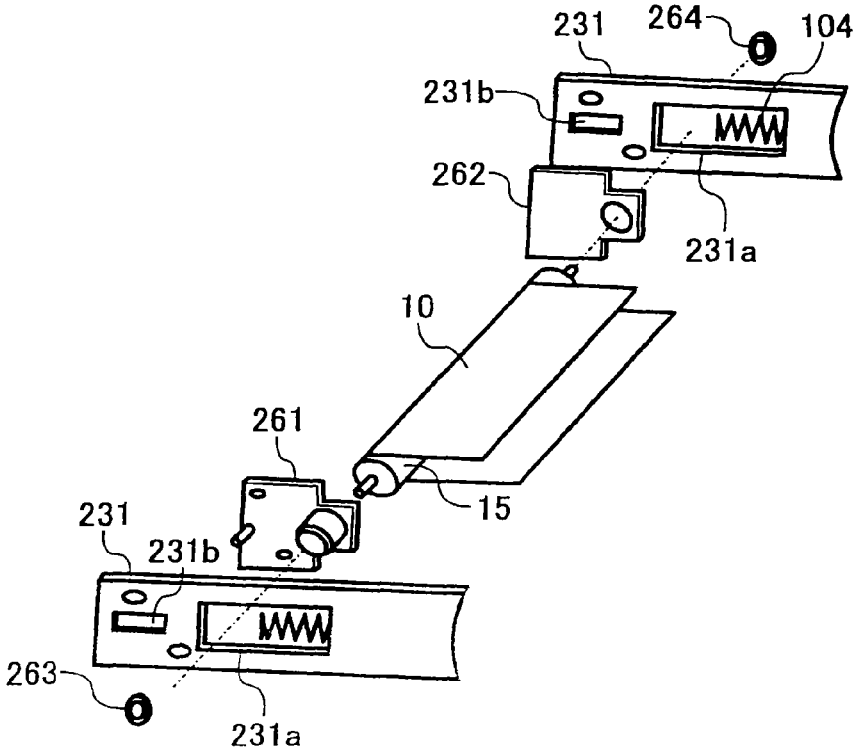
FIG. 17 is an exploded perspective view of components of a support mechanism, such as a tension roller and the side plate according to the fifth embodiment.
Figure 18:
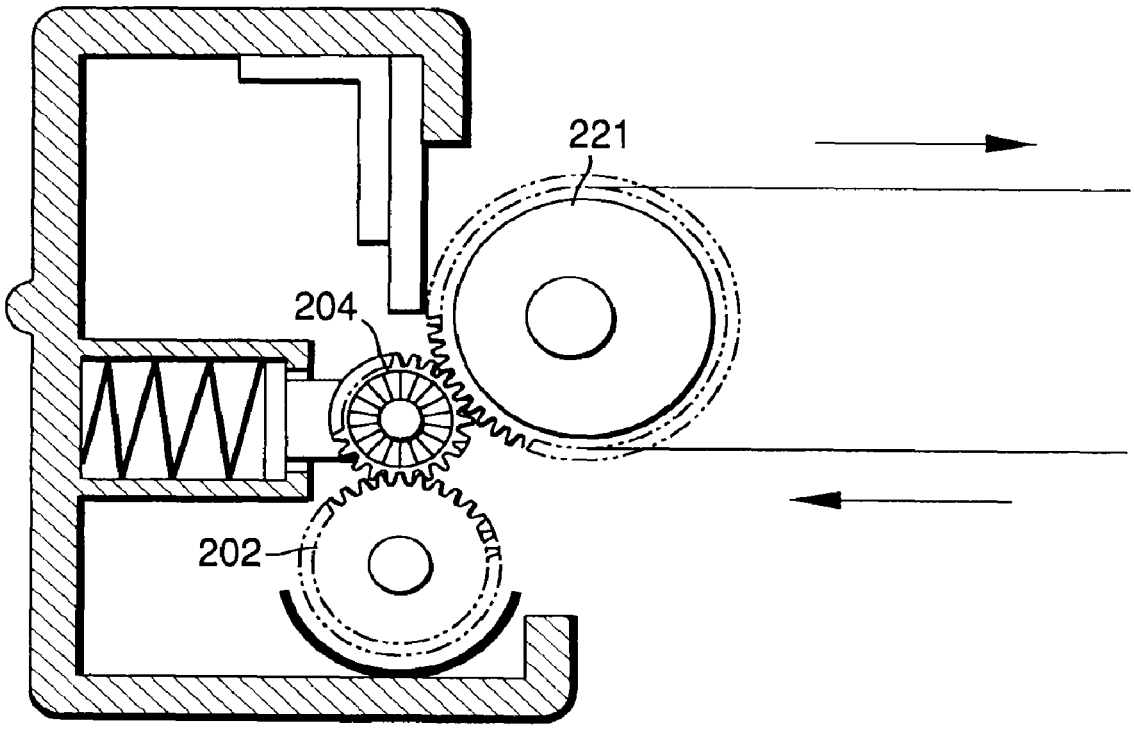
FIG. 18 is a cross-sectional view of a belt unit that includes a cleaning apparatus and an intermediate transfer member according to a fourth embodiment of the present invention.

FIG. 17 is an exploded perspective view of components of a support mechanism, such as a tension roller and the side plate. The cleaning apparatus 17*c* according to the fifth embodiment, which includes a main unit 271 and side plate portions 261 and 262 at both ends, is assembled in procedures similar to those of the second embodiment shown in FIG. 5. Specifically, first, the side plate portions 261 and 262 as separate from the main unit 271 are attached first to the tension roller 15, the intermediate transfer belt 10, and the side plates 231 located at front and rear positions by fittings 263 and 264. Then, the main unit 271 of the cleaning apparatus 17*c* is attached to the side plate portions 261 and 262. In the fifth embodiment, the bearing portions of the side plates 231 of the tension roller 15 are also integrated with both side plate portions of the cleaning apparatus 17*c*. With this structure, the cleaning apparatus 17*c* can be separated from the tension roller 15.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt unit, comprising:

an endless belt configured to carry an image and wrapped around at least three rollers including a drive roller and a driven tension roller, wherein the drive roller rotates the endless belt and the driven tension roller applies tension to the endless belt and is indirectly driven in accordance with movement of the endless belt;

a cleaning apparatus including a case which includes a gear, a screw which conveys discharged toner to a toner path, and a cleaning member configured to clean a surface of the endless belt; and a side plate configured to support the driven tension roller, the side plate including an elongated hole, wherein:

the driven tension roller is at a position opposing the cleaning apparatus, and the driven tension roller includes a gear mounted thereto and is configured to directly transmit a driving force to the gear of the case so that the case discharges using a rotational force from the drive roller which rotates the endless belt, which rotates the gear mounted to the driven tension roller, which rotates the gear of the case, and the cleaning apparatus further includes:

a positioning unit that is positioned with an axis of the driven tension roller; and a projection that is inserted into the elongated hole for positioning.

2. The belt unit according to claim 1, wherein the cleaning apparatus is configured to follow movement of the driven tension roller.

3. An image forming apparatus including the belt unit according to claim 2.

4. The belt unit according to claim 1, wherein the cleaning member is a cleaning blade.

5. An image forming apparatus including the belt unit according to claim 4.

6. An image forming apparatus including the belt unit according to claim 1.

7. The belt unit according to claim 1, wherein the case includes a brush roller.

8. An image forming apparatus including the belt unit according to claim 7.

9. The belt unit according to claim 7, further comprising:

a gear of the brush roller which is driven by the gear of the case.

10. The belt unit according to claim 9, further comprising:

a gear of the screw, wherein the gear of the brush roller directly drives the gear of the screw to turn the screw to convey the discharged toner to the toner path.

11. An image forming apparatus, wherein the image forming apparatus is configured to use the belt unit according to claim 1 as a photosensitive belt, an intermediate transfer belt, or a direct transfer belt.

12. A belt unit, comprising:

an intermediate transfer belt configured to carry an image and wrapped around a plurality of rollers including a drive roller and a driven tension roller, wherein the drive roller rotates the intermediate transfer belt and the driven tension roller applies tension to the intermediate transfer belt and is driven in accordance with movement of the intermediate transfer belt;

a cleaning apparatus including a case which includes a gear, a screw which conveys discharged toner to a toner path, and a cleaning member configured to clean a surface of the intermediate transfer belt; and a side plate configured to support the driven tension roller, the side plate including an elongated hole, wherein the driven tension roller is at a position opposing the cleaning apparatus, and the driven tension roller includes a gear mounted thereto and is configured to directly transmit a driving force to the gear of the case so that the case discharges using a rotational force from the drive roller which rotates the intermediate transfer belt, which rotates the gear mounted to the driven tension roller, which rotates the gear of the case, and wherein the cleaning apparatus includes:

a positioning unit that is positioned with an axis of the driven tension roller; and a positioning projection that is inserted into the elongated hole for positioning.

13. An image forming apparatus that includes a belt unit according to claim 12.

14. The belt unit according to claim 12, further comprising:

a brush roller within the case; and a gear of the brush roller which is driven by the gear of the case.

15. The belt unit according to claim 14, further comprising:

a gear of the screw, wherein the gear of the brush roller directly drives the gear of the screw to turn the screw to convey the discharged toner to the toner path.

* * * * *